US006382051B1

(12) United States Patent
Chang

(10) Patent No.: US 6,382,051 B1
(45) Date of Patent: May 7, 2002

(54) RATCHET WRENCH

(76) Inventor: Chih-Min Chang, No. 10, Chin Tun Lane, Chin Tun Village, Hua Tan Hsian, Chang Hua Hsien (TW)

( * ) Notice: Subject to any disclaimer, the term of this patent is extended or adjusted under 35 U.S.C. 154(b) by 0 days.

(21) Appl. No.: 09/945,789

(22) Filed: Sep. 5, 2001

(51) Int. Cl.[7] ..... B25B 13/46
(52) U.S. Cl. ..... 81/60
(58) Field of Search ..... 81/60, 61, 62, 81/63, 63.1, 63.2

(56) References Cited

U.S. PATENT DOCUMENTS

| | | | | | |
|---|---|---|---|---|---|
| 1,194,471 | A | * | 8/1916 | Boosinger | 81/60 |
| 3,265,171 | A | * | 8/1966 | Kilness | 81/63 |
| 4,991,468 | A | * | 2/1991 | Lee | 81/60 |
| 6,109,141 | A | * | 8/2000 | Nurmi | 81/60 |

* cited by examiner

*Primary Examiner*—Joseph J. Hail, III
*Assistant Examiner*—Joni B. Danganan
(74) *Attorney, Agent, or Firm*—Browdy and Neimark, P.L.L.C.

(57) ABSTRACT

A ratchet wrench includes a ratchet wheel rotatably mounted in a receiving portion at one end of a wrench body, a stop block mounted in an open chamber inside the wrench body and adapted to engage the ratchet wheel and to limit the direction of rotation of the ratchet wheel, and a spring mounted in the open chamber of the wrench body to support the stop block and to force the stop block into engagement with the ratchet wheel, the spring member having a mid-section stopped between one sidewall of the open chamber of the wrench body and a peripheral wall of the stop block, two coupling portions respectively extended outwardly from the midsection of the spring member and respectively positioned in a blind hole in one sidewall of the open chamber of the wrench body and a blind hole in one sidewall of the stop block.

3 Claims, 4 Drawing Sheets

RATCHET WRENCH

BACKGROUND OF THE INVENTION

The present invention relates to a ratchet wrench and, more particularly, to an improved structure of ratchet wrench.

As shown in FIG. 1, a conventional ratchet wrench 1 is generally comprised of a wrench body 10, a ratchet wheel 20, a stop block 30, and a spring 40. The two ends of the spring 40 are inserted to a hole 11 of the wrench body 10 and a hole 31 of the stop block 30 respectively to force the stop block 30 into engagement with the ratchet wheel 20, enabling the ratchet wheel 20 to be rotated in the wrench body 10 in one direction only. The spring 40 is mass-produced by machine, having the determined length. However, because the processing of the hole 11 is disposed inside the wrench body 10, its processing is not easy. A special machine tool is needed to make the hole 11. When processing the hole 11, it is difficult to control the depth of the hole 11. Therefore, the fabrication of this structure of ratchet wrench may encounter the following problems.

1. If the depths of the holes 11 and 31 are excessively deep, the spring 40 cannot be properly compressed to support the stop block 30 positively in positive, and the ratchet wheel 20 may disengage from the stop block 30 when operating the ratchet wrench to turn a bolt or nut.
2. On the contrary, if the depths of the holes 11 and 31 are excessively short, the spring 40 will be maintained in a compressed condition before the stop block 30 receiving a pressure. In this case, the ratchet wrench loses its precision of torsion.
3. When making the holes 11 and 31, it requires much effort to carefully examine the depths of the holes 11 and 31, enabling the holes 11 and 31 to match the spring 40 perfectly.

SUMMARY OF THE INVENTION

The primary objective of the present invention is to provide a ratchet wrench, which has a stable torsion structure that achieves high performance. It is another object of the present invention to provide a ratchet wrench, which is easy to manufacture.

To achieve these objects of the present invention, the ratchet wrench comprises a wrench body having a receiving portion, an open chamber inside the receiving portion, and a blind hole in one sidewall of the open chamber, a ratchet wheel rotatably mounted in the receiving portion of the wrench body, the ratchet wheel having a toothed peripheral wall, a stop block mounted in the open chamber of the wrench body and adapted to engage the toothed peripheral wall of the ratchet wheel and to limit the direction of rotation of the ratchet wheel, and a spring member mounted in the open chamber to support the stop block and to force the stop block into engagement with the ratchet wheel. The diameter of the midsection of the spring member is greater than the diameter of the blind hole of the open chamber, and the diameter of one end of the spring member is smaller than the diameter of the blind hold such that said end can be inserted into the blind hole and the midsection is stopped by the sidewall of the open chamber.

DETAILED DESCRIPTION OF THE PREFERRED EMBODIMENT

Figure 1:
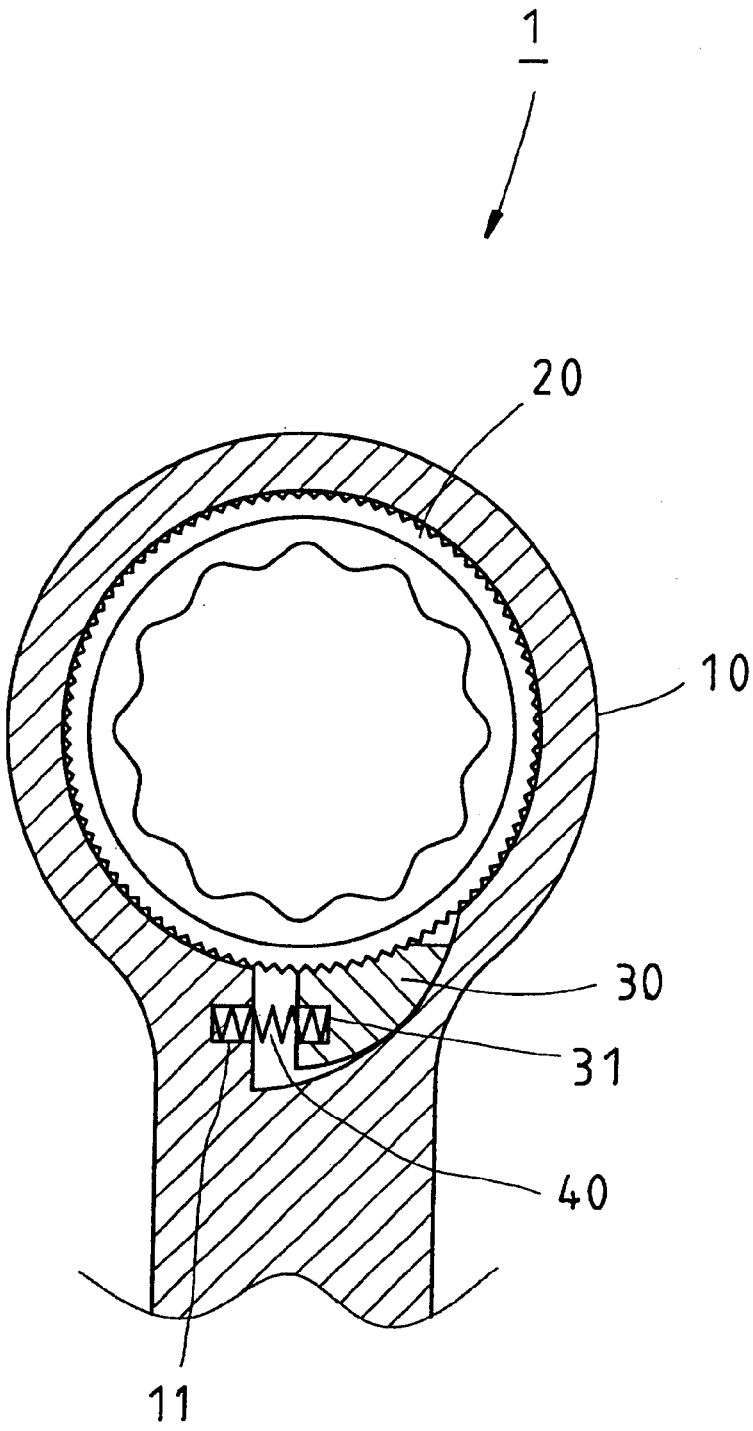
FIG. 1 PRIOR ART
FIG. 1 is a sectional view of a ratchet wrench according to the prior art.
Figure 2:
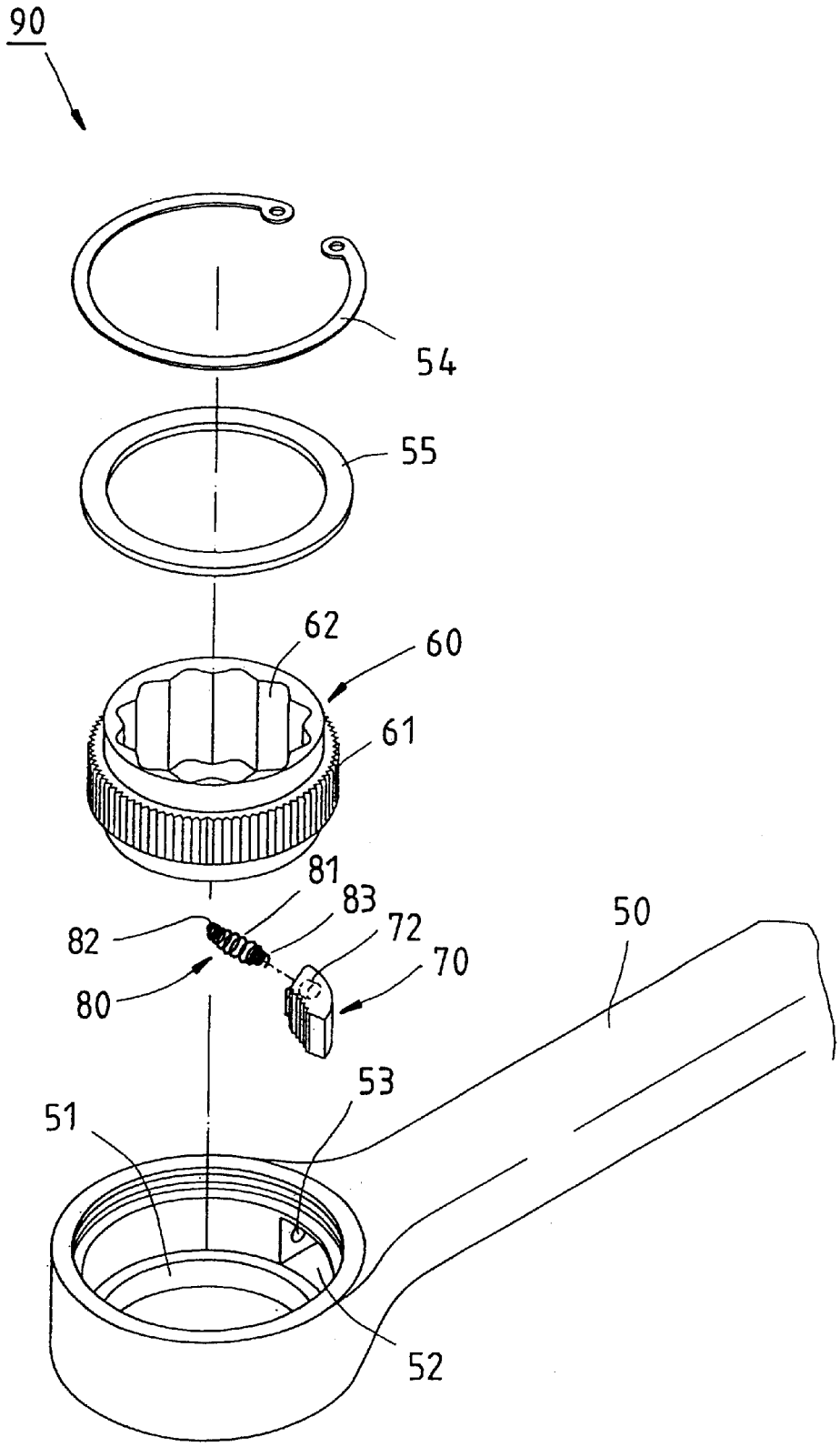
FIG. 2 is an exploded view of a ratchet wrench according to a first embodiment of the present invention.
Figure 3:
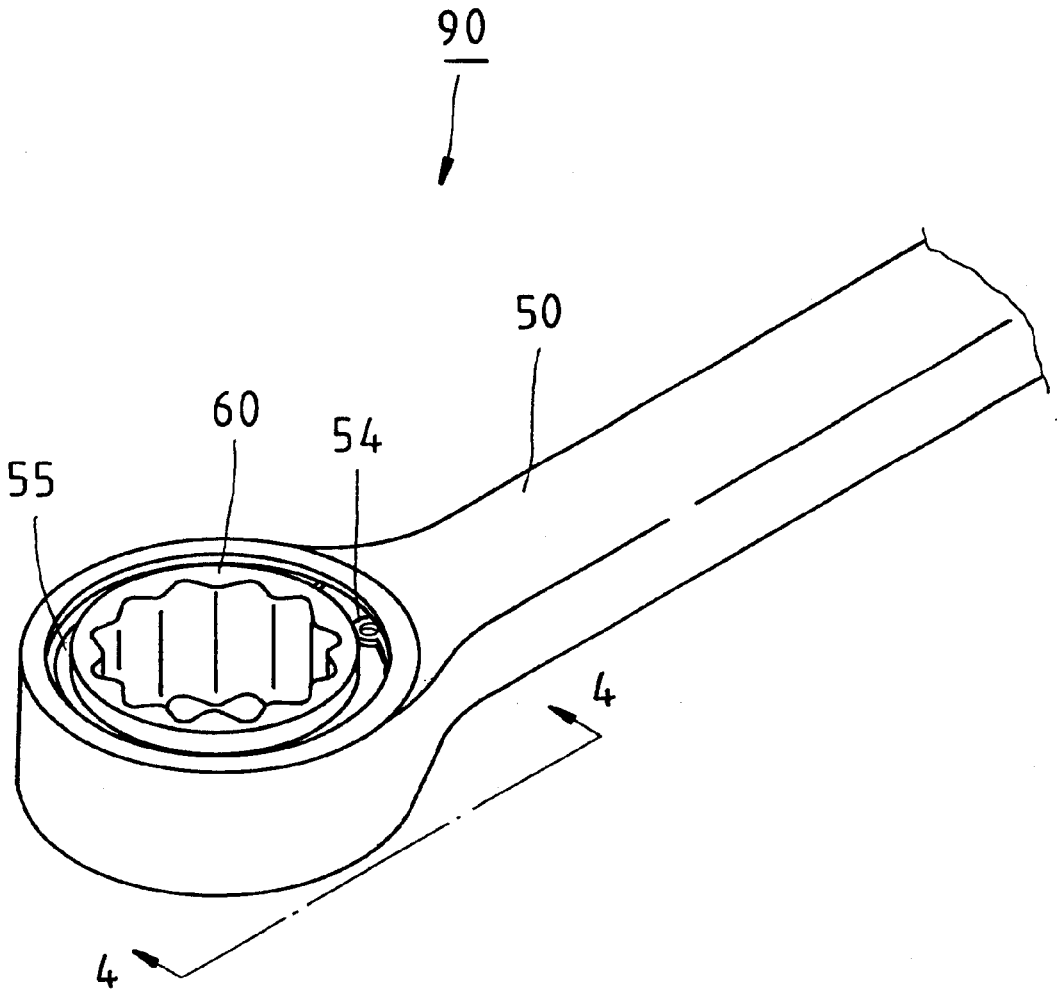
FIG. 3 is an elevational assembly view of the ratchet wrench according to the first embodiment of the present invention.
Figure 4:
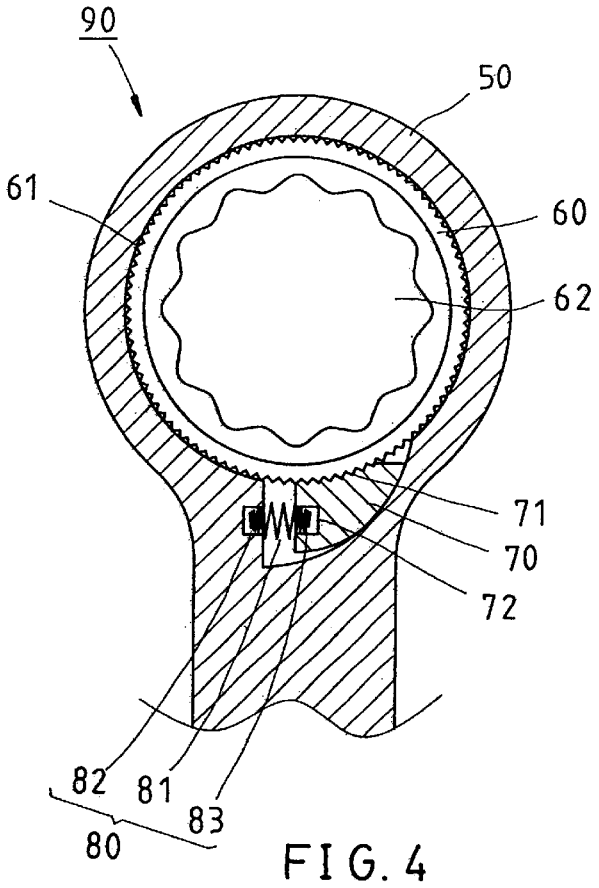
FIG. 4 is a sectional view taken along line 4—4 of FIG. 3.

Referring to FIGS. 2–4, a ratchet wrench 90 is shown constructed according to a first embodiment of the present invention, comprised of a wrench body 50, a ratchet wheel 60, a stop block 70, and a spring 80.

The wrench body 50 is an elongated rod-like member having a receiving portion 51 at its one end, an open chamber 52 disposed on the inside in communication with the holding space of the receiving portion 51, and a blind hole 53 disposed in one side of the open chamber 52. A packing ring 55 and a C-shaped retainer ring 54 are fastened to the receiving portion 51 of the wrench body 50 to secure the ratchet wheel 60, the stop block 70 and the spring 80 in the wrench body 50. The mounting arrangement of the wrench body 50 is of the known art, no further detailed description is necessary.

The ratchet wheel 60 is a hollow cylindrical member rotatably mounted in the receiving portion 51 of the wrench body 50, having a toothed peripheral wall 61 and a center coupling hole 62 adapted to engage a bolt or nut.

The stop block 70 is mounted in the open chamber 52 of the wrench body 50, comprising a toothed engagement portion 72 adapted to engage the toothed peripheral wall 61 of the ratchet wheel 60, and a blind hole 72 disposed at one side and adapted to hold one end of the spring 80. The toothed engagement portion 71 of the stop block 70 allows the ratchet wheel 60 to be rotated in the receiving portion 51 of the wrench body 50 in one direction. When rotating the ratchet wheel 60 in the receiving portion 51 of the wrench body 50 in the reversed direction, the toothed peripheral wall 61 is forced into engagement with the toothed engagement portion 71 of the stop block 70, prohibiting the ratchet wheel 60 from rotation.

The spring 80 is mounted in the open chamber 52 of the wrench body 50 to force the stop block 70 into engagement with the actuating member 60, comprising a midsection 81 and two coupling portions 82 and 83 at two ends thereof. The diameter of the coupling portions 82 and 83 is relatively smaller than the diameter of the blind holes 53 and 72. The diameter of the midsection 81 is greater than the diameter of the blind holes 53 and 72. When installed, the coupling portions 82 and 83 are respectively inserted into the blind holes 53 and 72, and the midsection 81 of the spring is stopped between the outside wall of the stop block 70 and the peripheral wall of the open chamber 52, as shown in FIG. 4. Because the midsection 81 of the spring is stopped between the outside wall of the stop block 70 and the peripheral wall of the open chamber 52 and the coupling portions 82 and 83 are respectively inserted into the blind holes 53 and 72, the precision of the depth of the blind holes 53 and 72 and the precision of the axial length of the spring 80 are less critical, and the spring force of the spring 80 is positively given to the stop block 70 against the ratchet wheel 60.

Figure 5:
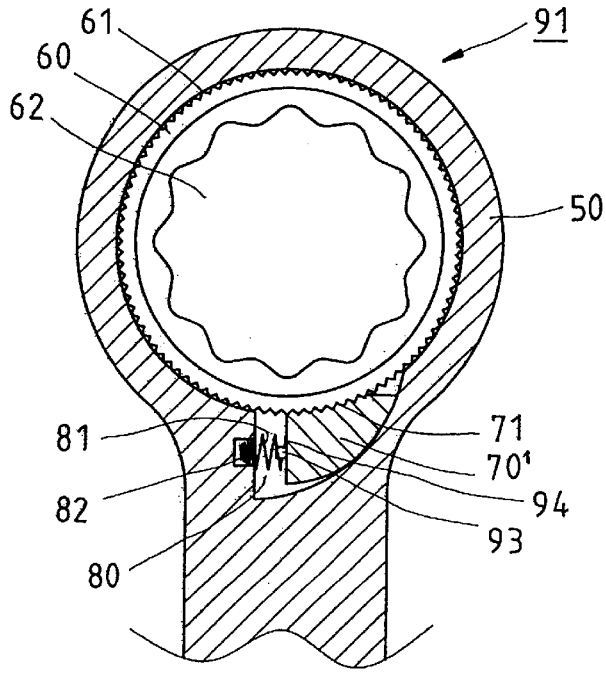
FIG. 5 is a sectional view of a ratchet wrench according to a second embodiment of the present invention.

FIG. 5 shows a ratchet wrench 91 according to a second embodiment of the present invention. According to this embodiment, the stop block 70 ' has a pin 93 disposed at one side. Further, the midsection 81 of the spring 80 has a diameter greater than the diameter of the blind hole 53 of the wrench body 50, and a first coupling portion 82 having a smaller diameter than the diameter of the blind hole 53 is inserted into the blind hole 53, and a second coupling portion 82 forms a sleeve like construction to hold the pin 93.

A prototype of ratchet wrench has been constructed with the features of FIGS. 2~5. The ratchet wrench functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A ratchet wrench comprising:

a wrench body provided at one end thereof with a receiving portion, said receiving portion having an open chamber and a blind hole in one sidewall of the open chamber;

a ratchet wheel rotatably mounted inside sa id receiving portion of said wrench body; said ratchet wheel having a toothed peripheral wall;

a stop block mounted in said open chamber of said wrench body, said stop block having a toothed engagement portion adapted to engage the toothed peripheral wall of said ratchet wheel and to limit the direction of rotation of said ratchet wheel in said receiving portion of said wrench body; and a spring member mounted in said open chamber and provided with a spring force against the stop block enabling said stop block to engage with said ratchet wheel;

wherein said spring member is provided with a midsection having a diameter greater than the diameter of the blind hole of said wrench body and a first coupling portion disposed at one end of said spring member and having a diameter smaller than the diameter of the blind hole of said wrench body such that the first coupling portion is inserted into the blind hole of said wrench body and the midsection of said spring member is stopped by the sidewall of the open chamber.

2. The ratchet wrench as claimed in claim 1 wherein said spring member further provides with a second coupling portion disposed at the other end of said spring member, and said stop block has a blind hole, which receives the second coupling portion of said spring member.

3. The ratchet wrench as claimed in claim 1 wherein said stop block comprises a pin extended from one side thereof, and said spring member further provides with a second coupling portion disposed at the other end of said spring member and coupled to the pin of said stop block.

* * * * *